United States Patent [19]

Carter

[11] Patent Number: 4,814,587

[45] Date of Patent: Mar. 21, 1989

[54] HIGH POWER SELF-REGULATING HEATER

[75] Inventor: Philip S. Carter, Palo Alto, Calif.

[73] Assignee: Metcal, Inc., Menlo Park, Calif.

[21] Appl. No.: 872,694

[22] Filed: Jun. 10, 1986

[51] Int. Cl.[4] ..... H05B 3/10; H05B 5/00; H01B 5/00; H01F 1/00

[52] U.S. Cl. ..... 219/552; 219/10.41; 219/10.47; 219/10.75; 219/10.77; 219/229; 219/553; 219/10.49; 174/126.2; 336/73; 336/177; 428/611; 428/615; 428/619

[58] Field of Search ..... 219/10.49, 41, 14, 10.75, 219/10.77, 552, 553, 229; 148/13, 31.55, 33; 428/611, 615, 619, 653; 174/126 CP; 336/73, 177

[56] References Cited

U.S. PATENT DOCUMENTS

| | | | |
|---|---|---|---|
| 2,181,274 | 11/1939 | Jackson et al. | 219/10.75 |
| 3,579,313 | 5/1971 | Pryor et al. | 428/653 |
| 4,256,945 | 3/1981 | Carter et al. | 219/10.75 |
| 4,626,767 | 12/1986 | Clappier et al. | 323/280 |

*Primary Examiner*—E. A. Goldberg
*Assistant Examiner*—Gerald E. Preston
*Attorney, Agent, or Firm*—Hall, Myers & Rose

[57] ABSTRACT

An improved performance ferromagnetic self-regulating heater. Constant alternating current is applied to a layered structure including at least one ferromagnetic layer. One or more layers of non-magnetic material is added to the ferromagnetic layer in such a way that the power factor of the heater is very significantly increased above its value in the absence of at least one of the layers. The alternating current flows through the different layers in varying quantities depending on layer composition, temperature and Curie point of the ferromagnetic layer. The structure generates heat by resistive heating as a function of the power applied. In one embodiment a single layer of non-magnetic, high-resistance material is in intimate electrical and thermal contact with one surface of the ferromagnetic material. Below the effective Curie temperature of the ferromagnetic layer the current is mainly confined in the non-magnetic layer which heats with greater efficiency due to better resistive and impedance chararacteristics. In a second embodiment a further non-magnetic, low-resistance layer is added to the opposite surface of the ferromagnetic material. Here the majority of the current is switched from the high-resistance to the low-resistance layer as the heater approaches effective Curie. Accordingly, impedance matching circuit losses can be substantially reduced and energy is saved in high power systems based on the power factor.

13 Claims, 11 Drawing Sheets

$f = 2.0$ MHZ

| $\mu_2$ | $I_2/I$ | S/R | PF | R5 |
|---|---|---|---|---|
| 1 | 13.4 | 11.0 | .94 | .027 |
| 300 | .79 | – | .71 | .0024 |

$f = 10.0$ MHZ

| $\mu_2$ | $I_2/I$ | S/R | PF | R5 |
|---|---|---|---|---|
| 1 | 5.86 | 6.7 | .98 | .036 |
| 300 | .0035 | – | .72 | .0054 |

S/R, PF AND $R_S$ VS FREQUENCY

RESISTANCE, REACTANCE AND POWER FACTOR VS FREQUENCY AT ROOM TEMPERATURE (SMALL SIGNAL)

RATIO OF RESISTANCES, $\frac{R\ (0°C)}{R\ (70°C)}$ VS FREQUENCY OF SMALL SIGNAL TEST RESISTANCE AND REACTANCE
VS
TEMPERATURE
FREQ. = 13.56 MHz
FIXTURE HEATED FROM ROOM
TEMPERATURE WITH 13.56 MHz POWER
R + X OHMS
40
35
30
25
20
15
10
5
20
25
30
35
40
45
50
55
60
65
70
75
T — °C
X
R
S/R = R(25°C) / R(70°C)
= 36.8 / 5.5 = 6.7

HIGH POWER SELF-REGULATING HEATER

BACKGROUND OF THE INVENTION

The present invention relates to ferromagnetic self-regulating heaters. More particularly, the present invention relates to ferromagnetic self-regulating heaters with secondary performance enhancing layers.

This application relates to autoregulating ferromagnetic heaters of the type described in U.S. (Pat. No. 4,256,945 to Carter and Krumme; the parts of the disclosure relating to skin effect, skin depth and autoregulating ratios being incorporated herein by reference.

Autoregulating heaters using a high resistivity, high permeability magnetic surface layer on a non-magnetic magnetic low resistivity substrate have been developed to a point where they are useful in a variety of applications. Their successful operation depends on their ability to contain the current in the magnetic surface layer which is also the heating layer since it has a high resistivity. Thus a magnetic surface layer having both high permeability and high resistivity is required. It must also have the proper Curie temperature for the intended application. One disadvantage of this scheme is that at high power levels the magnetic fields in the surface magnetic layer may be very high, in some applications of the order of many oersteds, causing the effective permeability to be relatively low due to saturation.

Also, the power factor (PF) of the impedance of the magnetic surface layer heaters described above is relatively low e.g., 0.7 at temperatures below Curie, leading to the necessity of using reactive power factor correction elements in the tuning circuit. The power factor behavior of a design shows the approach of the power factor to a maximum value of 0.707 as the magnetic layer thickness increases.

The present invention provides a means for overcoming the above restrictions by adding further layers of material. Many improvements occur from this additional layer; high power factor below Curie, simplifying impedance matching; more flexibility in the overall design, including the requirements on the magnetic layer; higher effective permeability in the magnetic layer; a broad frequency range over which good performance, i.e., high self-regulation (S/R) ratio and high power factor are maintained.

The self-regulation (S/R) ratio is an important parameter in autoregulating heater design. This ratio refers to the ratio of overall resistance of the heater below effective Curie to the heater resistance above effective Curie. This change in resistance coupled with a constant current causes the heater to generate drastically less heat for a given amount of current when the temperature of the heater is above Curie. Therefore, the magnitude of the S/R ratio determines the effectiveness of autoregulation.

Jackson and Russel in U.S. Pat. No. 2,181,274 use a sheath of non-magnetic material (they suggest brass) on a magnetic material base. They couple to this structure inductively. Conditions for maximum efficiency, or maximum power factor, or the best possible combination of efficiency and power factor are disclosed. Jackson does not claim an ohmicly connected heater nor mention self-regulation. Jackson's approach which uses low frequencies does not mention or use Curie temperature self-regulation and does not appear to take advantage of the improved effective permeability of the ferromagnetic material; a factor of great importance in effective autoregulation.

SUMMARY OF THE INVENTION

In a first embodiment of the present invention, a layer of ferromagnetic material is combined with a non-magnetic, high-resistance surface layer. A high frequency alternating current source is connected across the two layers in parallel. Heat is generated by resistive heating as a function of power supplied to the structure.

The magnetic properties of the ferromagnetic material in combination with the high frequency current source creates a skin effect which confines a larger portion of the current to a narrow depth at the surface of the structure. In the absence of the high-resistance, non-magnetic surface layer, the majority of the current would be confined to a narrow surface portion of the ferromagnetic layer. The power factor and heating would therefore be determined to a great extent by the resistivity and reactance of that portion of the ferromagnetic material in which the majority of the current flows.

When the non-magnetic surface layer is added to the structure, a majority of current flow may be shifted to that layer by the skin effect. By selecting a material with more desirable resistance and reactance characteristics for the surface layer, the power factor for resistive heating of the whole structure can be enhanced.

The ferromagnetic material has an effective Curie temperature at which it becomes essentially non-magnetic. As this temperature is reached, the skin effect diminishes and therefore the current is more evenly distributed throughout the whole structure including the ferromagnetic layer through which a greater portion of the current now flows. At all times the total current into the structure is maintained at an essentially constant level.

By maintaining a constant supply of current while increasing the cross-sectional area through which the current now flows, a decrease in the quantity of resistive heating is produced. Therefore autoregulation about a predetermined effective Curie temperature is accomplished.

The term "constant current" and other like terms as employed herein and used to refer to current supplied to the structure, does not mean a current which cannot increase but means a current that obeys the following formula:

$$\frac{\Delta|I|}{|I|} < \frac{1}{2}\frac{\Delta R}{R}$$

found and fully described in patent application Ser. No. 568,220 filed to Rodney Derbyshire, the disclosure relative to this factor being incorporated herein by reference.

Specifically, in order to autoregulate, the power delivered to the load when the heater exceeds Curie temperature must be less then the power delivered to the load below Curie temperature. If the current is held invariable, then the best autoregulation ratio is achieved short of controlling the power supply to reduce current. So long as the power is reduced sufficiently to reduce heating below that required to maintain the temperature above the effective Curie temperature, the current can be allowed to increase somewhat and auto-regulation is still achieved. Thus, when large auto-regulating ratios are not required, constraints on the degree of current control may be relaxed; reducing the cost of the power supply.

In a second embodiment a single ferromagnetic layer is covered by an outer high-resistive, non-magnetic layer and an inner low-resistance, non-magnetic layer. The ferromagnetic layer acts as a switch which utilizes the skin effect to direct the major portion of the current through the high-resistance region when below the effective Curie temperature and to direct the majority of the current through the low-resistance layer above Curie. At no time does a major portion of the current flow through the ferromagnetic layer.

This second configuration enables the heater to utilize the higher power factor available from the high-resistance layer when maximum resistive heating is needed below effective Curie. Also resistive heating is severely diminished when the majority of current flow is switched to the low-resistance layer, allowing for enhanced autoregulation.

The usual considerations relating to the design of a ferromagnetic self-regulating heater apply here including the width to thickness ratio of a non-enclosed magnetic path (approx. 50:1) where the high mu of the ferromagnetic material is to be maintained at or near its maximum value. Inductive means can be used to couple the AC source to the heater.

The structure must be designed to obtain the desired, improved, power factor at the same time maintaining other needed heater properties such as a reasonable self-regulation power ratio. The addition of the resistive layer does lower the self-regulation ratio. In most cases this is no problem since a sufficient ratio is still attainable.

The addition of the resistive layer may reduce the heater resistance at temperatures below the Curie temperature, but not seriously enough to be considered a tradeoff problem.

The heater's properties, i.e., power factor and self-regulation ratio, depend upon a chosen set of layer parameters, i.e., permeability, resistivity, dielectric constant, and thickness, and upon the chosen AC frequency; usually in the MHz range.

The tradeoffs among power factor, self-regulation ratio, and resistance level $R_s$ depend upon the particular design goals. This disclosure does, however, teach the design principles sufficient to build an improved autoregulating heater for any application.

BRIEF DESCRIPTION OF THE DRAWINGS

For a further understanding of the nature and objects of the present invention, reference should be made to the following detailed description, taken in conjunction with the accompanying drawings in which like parts are given like reference numerals and wherein.

The graphs illustrated of FIGS. 5–10 and 17 are based on calculated rather than experimental data.

DETAILED DESCRIPTION OF THE PREFERRED EXEMPLARY EMBODIMENTS

Figure 1:
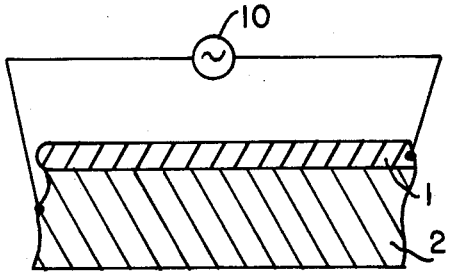
FIG. 1 is a side sectional view of the preferred embodiment of the two-layer version of the present invention.

The first embodiment of the present invention, as illustrated in FIG. 1, comprises a layer of ferromagnetic material 2 surrounded by a non-magnetic high-resistance surface layer 1. A high frequency alternating current source 10 is connected across the two layers in parallel. Heat is generated by resistive heating as a function of power supplied to the layers.

The magnetic properties of the ferromagnetic material 2 in combination with the high frequency current source 10 creates a "skin effect". As detailed in U.S. Pat. No. 4,256,945 to Carter and Krumme, the "skin effect" is characterized by alternating currents concentrated more heavily in the surface regions of the conductor than in the interior volume thereof. The high concentration of current at the surface region of the conductor is more pronounced the higher the frequency. However, from what dent upon the magnetic permeability of the conductor. In a "thick" conductor having a planar surface and a thickness T, energized by an alternating current source connected to produce a current parallel to the surface, the current density under the influence of the skin effect can be shown to be an exponentially decreasing function of the distance from the surface of the conductor.

$$j(x)=j_0e^{-x/s}$$

where j(x) is the current density in amperes per sq. meter at a distance x in the conductor measured from the surface, $j_0$ is the current magnitude at the surface, and s is the "skin depth" which in mks units is given by:

$$s\ 2/\mu\sigma\cap, \text{ for } T >> s.$$

Where $\mu$ is the permeability of the material of the conductor, $\sigma$ is the electrical conductivity of the material of the conductor and $\omega$is the radian frequency of the alternating current source. In discussing the relationship of the skin effect to the magnetic properties of materials, it is convenient to talk in terms of the relative permeability $\mu_r$, where $\mu_r$ is the permeability normalized to $\mu_v$, the permeability of vacuum and $\mu_v=4\times10^{-7}$ henry/meter. Thus, $\mu_r\mu/\mu_v=\mu/4\pi\times10^{-7}$. For non-magnetic materials, $\mu_r=1$.

The foregoing relationship of current density as a function of distance from the surface, although derived for a thick planar conductor, also holds for circular cylindrical conductors having a radius of curvature much larger than the skin depth s.

In the absence of the non-magnetic surface layer 1, the majority of the current would be confined to a narrow surface portion of the ferromagnetic layer 2. The power factor would therefore be determined by the resistivity and permeability of that portion of the ferromagnetic material 2 in which the majority of the current flows.

When the non-magnetic surface layer 1 is added to the structure and the thickness of layer 1 is properly chosen the majority of current flow is shifted to layer 1 by the skin effect. By selecting a material with more desirable resistivity and permeability characteristics for the surface layer as opposed to the layer 2, the power factor for resistive heating of the whole structure can be enhanced.

The ferromagnetic material 2 has an effective Curie temperature at which it becomes essentially non-magnetic. As this temperature is reached, the skin effect diminishes and therefore the current is more evenly distributed throughout the whole structure including the ferromagnetic layer 2 through which a greater the ferromagnetic layer 2 through which a greater portion of the current now flows. At all times the total current into the structure is maintained at an essentially constant level.

By maintaining a supply of constant current while increasing the cross-sectional area through which the current will now flow there is a decrease in the quantity of resistive heating produced. Therefore autoregulation about a predetermined effective Curie temperature is accomplished. The relative resistivities of the layers must also be considered since the layer may be selected to have a higher resistivity than layer 2.

Figure 4:
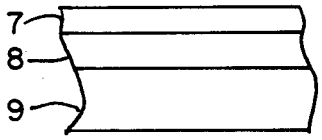
FIG. 4 is a side sectional view of the preferred embodiment of the three-layer version of the present invention.

In an alternative embodiment shown in FIG. 4, a single ferromagnetic layer 8 is covered by an outer high-resistive, non-magnetic layer 7 and an inner low-resistance, non-magnetic layer 9. The ferromagnetic layer 8 acts as a switch to direct the major portion of the current to the high-resistance region 7 when below the effective Curie temperature or through the low-resistance layer 9 above Curie. At no time does a significant portion of the current flow through the ferromagnetic layer 8.

This configuration enables the heater to utilize the high power factor available from the high-resistance layer 7 when maximum resistive heating is needed below effective Curie. Also resistive heating is severely diminished when the majority of current flow is switched to the low-resistance layer 9.

At temperatures below Curie due to the skin effect produced by magnetic layer 8 and the frequency of the current, a substantial fraction of the AC current flows in the resistive surface layer 7, producing a relatively high power factor. As the temperature approaches Curie the decline in permeability of the magnetic layer 8 is no longer effective in maintaining this current distribution, the current now flows mainly in the underlying layer 9 where significantly less heat is generated due to the low resistance of this layer.

The usual considerations relating to the design of a ferromagnetic self-regulating heater apply here including the width to thickness ratio considerations for the ferromagnetic material design to avoid demagnetizing effects if flat layers are used and a return path is provided.

Figure 2:
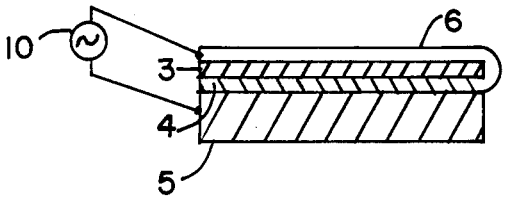
FIG. 2 is a side sectional view of the preferred embodiment of the two-layer version of the present invention utilizing the proximity effect of the overlapping connector.
Figure 3:
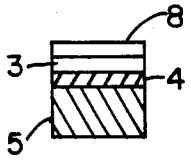
FIG. 3 is an end view showing the cross-sectional area of the layers of the embodiment shown in FIG. 2.

An ohmic connection which permits the use of flat layers is illustrated in FIG. 2.

Figure 6:
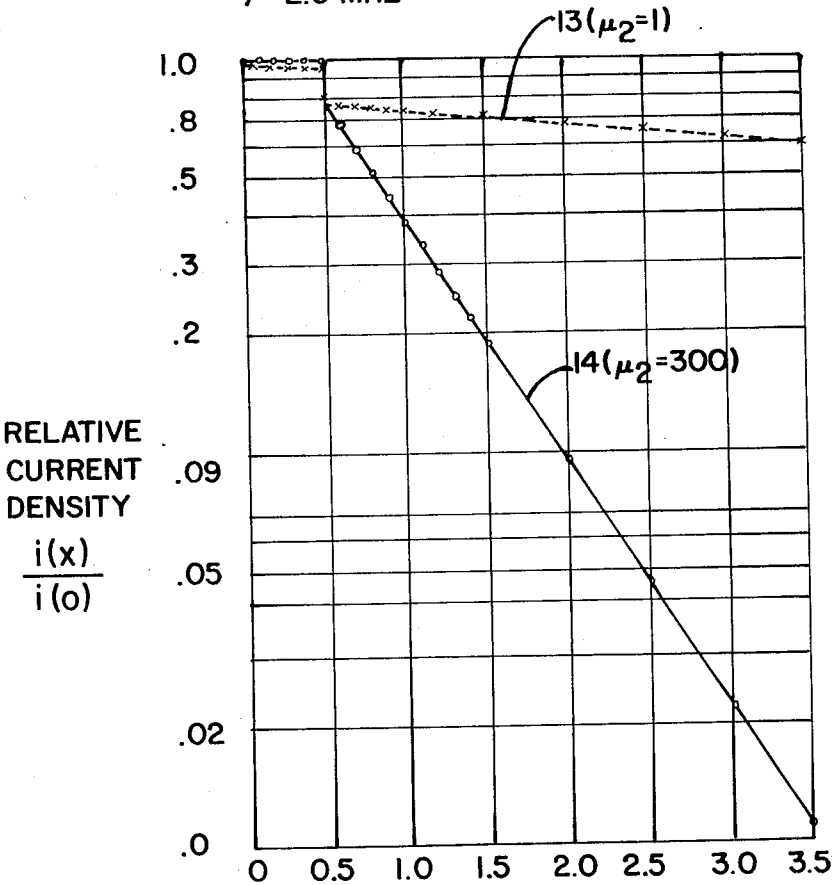
FIG. 6 is a graph illustrating the current density of a two-layer heater below Curie as a function of the distance from the surface of the heater at an alternating current frequency of 2 MHz.
Figure 5:
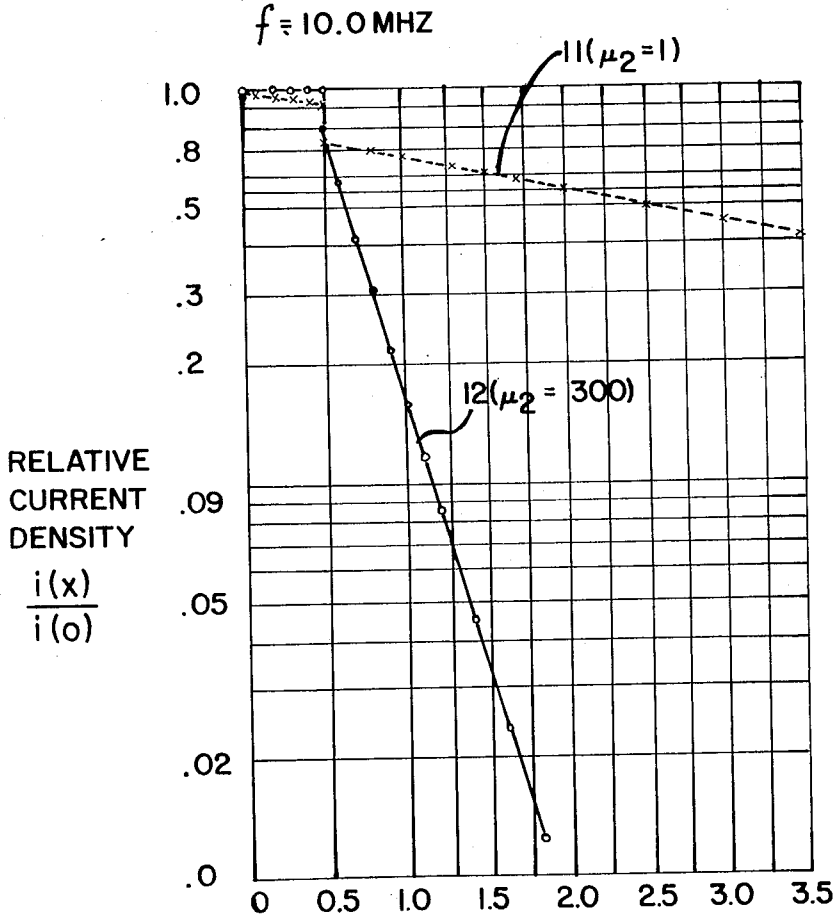
FIG. 5 is a graph illustrating the current density of a two-layer heater below Curie as a function of the distance from the surface of the heater at an alternating current frequency of 10 MHz.

For the case of a thick ($t >> \delta$) magnetic layer 2, as illustrated in FIG. 1, current distribution calculations are shown in FIGS. 5 and 6. The graphs illustrate how the quantity of current diminishes at distances farther from the surface of the heater. The curves 12 and 14 illustrate the case of a ½ mil thick layer of 60 microhm-cm material on a substrate of magnetic material having a below Curie permeability of 300. The current density magnitude is almost uniform in the resistive layer at both frequencies, 2 MHz and 10 MHz, and both below and above Curie.

For the two-layer case (FIG. 1) the calculated integrated currents $I_1$ and $I_2$ in both layers and both below and above Curie are also shown (as the ratio $I_2/I_1$) in FIGS. 5 and 6. In both cases, below Curie most of the current is in the resistive layer 1 while above Curie most of the current is in the magnetic layer 2 by a large factor.

Table I lists the electrical properties of a heater based on the configuration of FIG. 1. Surface impedance $R_2+jX_s$, self-regulation ratio and power factor are tabulated for several values of magnetic material permeability $\mu_2$ ranging from 200 to 1. This range of permeabilities is not too different from those found in Alloy 42, Invar 36 and other nickel iron alloys having Curie temperatures in the 60° C. to 400° C. range. The values of resistivity $\phi_2$ of the magnetic layer, $75\times10^{-}$ohm-cm, is close to the value for Alloy 42 and several other nickel-iron alloys. The two values of resistivity chosen for the non-magnetic layer correspond respectively to materials such as austenitic stainless steel and nichrome.

The power factor is increased to near unity for high values of the permeability according to Table I and proper layer thicknesses; see the various graphs of FIGS. 7–9 and 17. Accordingly with proper design of the heater geometry, the input impedance is almost purely resistive and can be made almost any desired value in most cases, thus impedance matching circuitry is eliminated.

Table I also shows that increasing the resistivity of the surface layer 1 from 60 to 100 microhm-cm causes the power factor at 100 microhm-cm and $\mu_2=200$ to decrease only slightly below its value at 60 microhm-cm, and causes the self-regulation ratio (at $\mu_2=1$) to improve by 40 percent over the 60 microhm-cm. This is an important tradeoff.

Table II presents calculations of surface impedance, power factor, and self-regulation ratio for the single magnetic layer without the resistive layer. A better self-regulation ratio is achieved, but the power factor is much worse at $\mu_2=200$ and the heater will require impedance matching to efficiently couple to the power supply. It is also noted, referring again to Table I, that the power factor is always better with the resistive layer with only one exception; the $\mu_2=1$, $\phi_1=100$ microhm-cm value of power factor, 67.5%, is slightly worse than the $\mu=1$ power factor, 68.9%, in Table II.

TABLE I

Calculated Self-Regulation Ratios and Power Factors With Non-Magnetic Resistive Layer On Magnetic Material Similar To Alloy 42

| $\mu_2$ — | $\rho_1$ Ohm-cm | $R_s$ Ohms | $X_s$ Ohms | Self-Regulation Ratio $P(\mu\text{-}200)/P(\mu)$ | Power Factor % |
|---|---|---|---|---|---|
| 200 | $60 \times 10^{-6}$ | .0359 | .00805 | — | 97.6 |
| 10 | " | .0170 | .00999 | 2.11 | 86.2 |
| 1 | " | .00615 | .00615 | 5.8 | 70.7 |
| 200 | $100 \times 10^{-6}$ | .0502 | .0159 | — | 95.3 |
| 10 | " | .0186 | .0133 | 2.7 | 81.4 |
| 1 | " | .0062 | .0068 | 8.1 | 67.5 |

TABLE II

Calculated Self-Regulation Ratios and Power Factors of Single Layer Heater Without Resistive Layer

| $\mu_2$ — | $\rho_1$ Ohm-cm | $R_s$ Ohms | $X_s$ Ohms | Self-Regulation Ratio $P(\mu\text{-}200)/P(\mu)$ | Power Factor % |
|---|---|---|---|---|---|
| 200 | $75 \times 10^{-6}$ | .0897 | .0896 | — | 70.6 |
| 10 | " | .0200 | .0200 | 4.5 | 70.7 |
| 1 | " | .0061 | .0064 | 14.7 | 68.9 |

TABLE III

Calculated Self-Regulation Ratios and Power Factors With Non-Magnetic Layer Added to a Two-Layer Self-Regulating Heater

| $\mu_2$ — | $\rho_1$ Ohm-cm | $R_s$ Ohms | $X_s$ Ohms | Self-Regulation Ratio $P(\mu\text{-}200)/P(\mu)$ | Power Factor % |
|---|---|---|---|---|---|
| 200 | $60 \times 10^{-6}$ | .036 | .0081 | — | 98 |
| 9 | " | .0051 | .012 | 7.1 | 38 |
| 5 | " | .0026 | .0083 | 13.9 | 30 |
| 1 | " | .0011 | .0035 | 32.7 | 30 |
| 200 | (No | .087 | .1 | — | 66 |
| 9 | Layer) | .0022 | .015 | 39.6 | 15 |
| 5 | | .0015 | .008 | 58 | 18 |
| 1 | | .0010 | .0022 | 87 | 41 |

The usefulness of a resistive layer in a multilayer heater configuration is illustrated in Table III and FIG. 4 where a non-magnetic top layer 7 is combined with a second layer 8 of temperature sensitive magnetic material on a highly conductive non-magnetic substrate 9. The top layer 7 might be a non-magnetic stainless steel, the second layer 8 might be Alloy 42, and the third layer 9 might be copper. The first set of four calculations are for $\phi_1=60$ microhm-cm. The second set is for $\phi_1=10^{20}$, thus simulating the absence of the top layer. Again, in all cases except $\mu_2=1$, the power factor with the third layer is very substantially improved, again at some expense in self-regulation ratio (S/R).

Referring again to FIGS. 5 and 6, we note that the embodiment of FIG. 1 yields S/R regulation ratios of 11.0 and 6.7 at 2 MHz and 10 MHz respectively. The 10 MHz below Curie temperature power factor (PF) is slightly better, i.e., 0.98, than the 2MHz power factor value, 0.94. This is achieved at the expense of a smaller regulation ratio. Without the resistive layer this heater would have a regulation ratio equal to 17.3. Thus by proper choice of thickness and surface resistivity, one can achieve a substantial increase in power factor with only a modest reduction in S/R.

The second embodiment, illustrated in FIG. 4, incorporates a third, low resistivity, low permeability layer 9 on the opposite surface of the magnetic layer 8. Below Curie, a substantial fraction of the current will flow in the high-resistive surface layer 7 (due to skin effect). Above Curie, most of the current will flow in the third, low resistivity layer 9. Calculations of the surface resistances and the self-regulation ratio (S/R) show that much of the current flows in this third layer 9 when above Curie.

There are many design parameters to choose in the three-layer system. Two qualitatively different modes of operation are possible which offer benefits and advantages. In the first mode, Mode A, the magnetic layer thickness is between one skin depth and several skin depths. In the other mode, Mode B the magnetic layer thickness is in the range of $\frac{1}{3}$ to $\frac{2}{3}$ of a skin depth. These are discussed in turn below.

Figure 7:
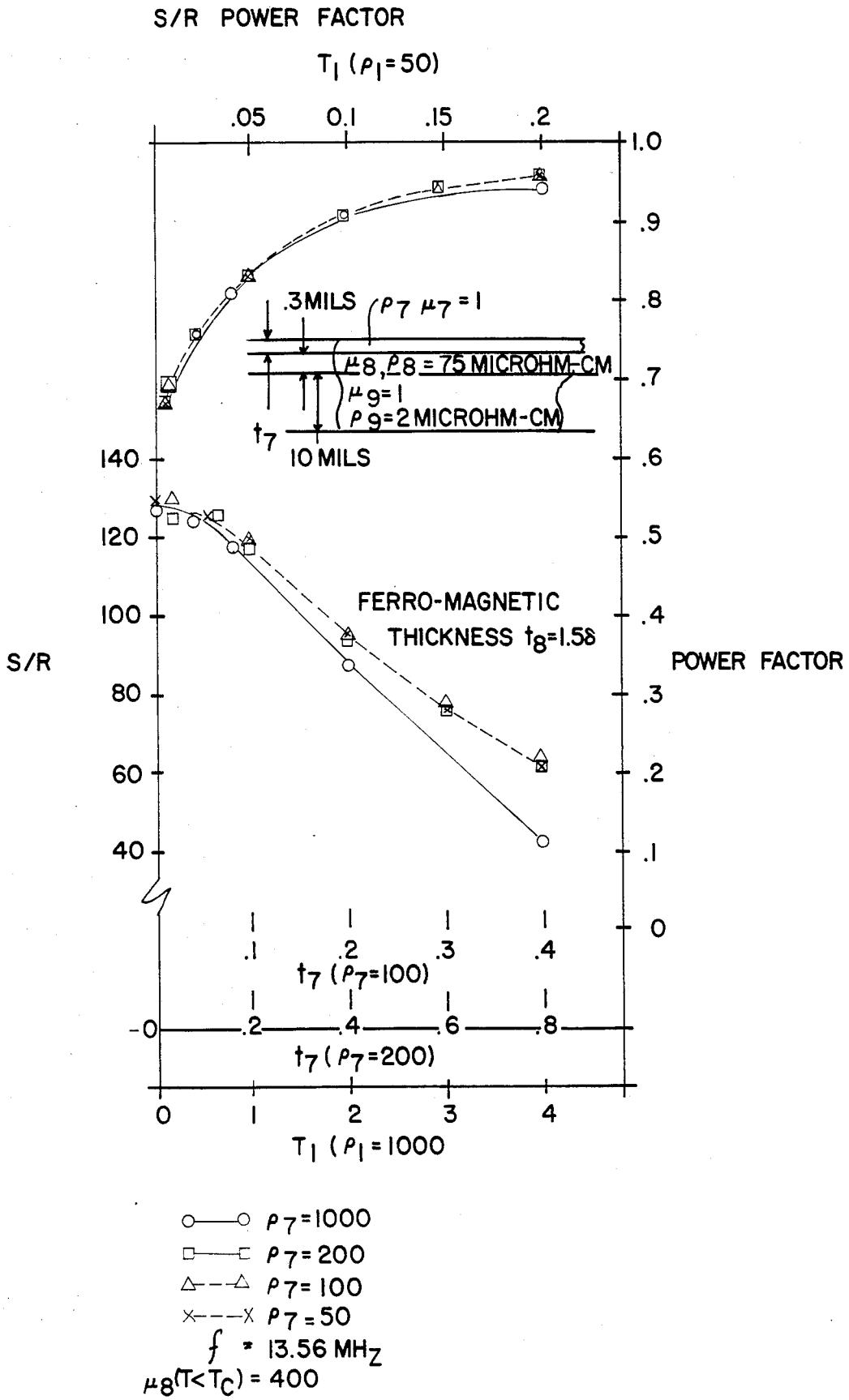
FIG. 7 is a graph illustrating the relationship between autoregulating ratio (S/R) and power factor (PF) as a function of outer resistive layer thickness.

FIG. 7 depicts in Mode A, the S/R and PF as a function of resistive layer 7 thickness $t_7$ for the case, at $f=13.56$ MHz, where the magnetic layer 8 thickness $t_8$ is approximately 0.3 mils in the chosen material, or roughly 1.5 skin depths. In this case (and in cases where the magnetic layer is still thicker) the S/R is a monotonically declining function of resistive layer 7 thickness $t_7$ and the power factor is a monotonically increasing one. FIG. 7 includes calculations for two different values of resistive layer resistivity, $\phi_7=100$ microhm-cm and 200 microhm-cm. The two curves fall practically on top of one another when, as shown here, the scale for the $\phi_7=100$ thickness axis ($t_7$) is expanded, i.e., $t_7(\phi_7=100)=\frac{1}{2}t_7(\phi_7=200)$. The physical significance of the identical behavior of the two cases under this transformation is that the resistance of the surface layer 7 is the same for both cases. Another way of stating this is that the ratio of the layer thickness to the layer resistivity is maintained constant while changing both parameters, i.e., $t_7/\omega_7=$constant is a transformation rule that allows modification of these two parameters without changing the electrical characteristics of the device. This is a special case of the general rule for the three-dimensional case for which the rule is $l^2/\phi=$constant where l is the "scale" of the configuration (in our one-dimensional case the linear dimension, i.e., $t_7$ is not squared).

The usefulness of this "A" mode, in which the magnetic layer thickness is greater than about 1.5 skin depths, is at the higher frequencies where a thin magnetic layer would be difficult to achieve, for instance by roll cladding or sputtering. Large S/R ratios (90) are achievable coincident with high below-Curie, power factors, e.g., greater than 0.9.

Figure 8:
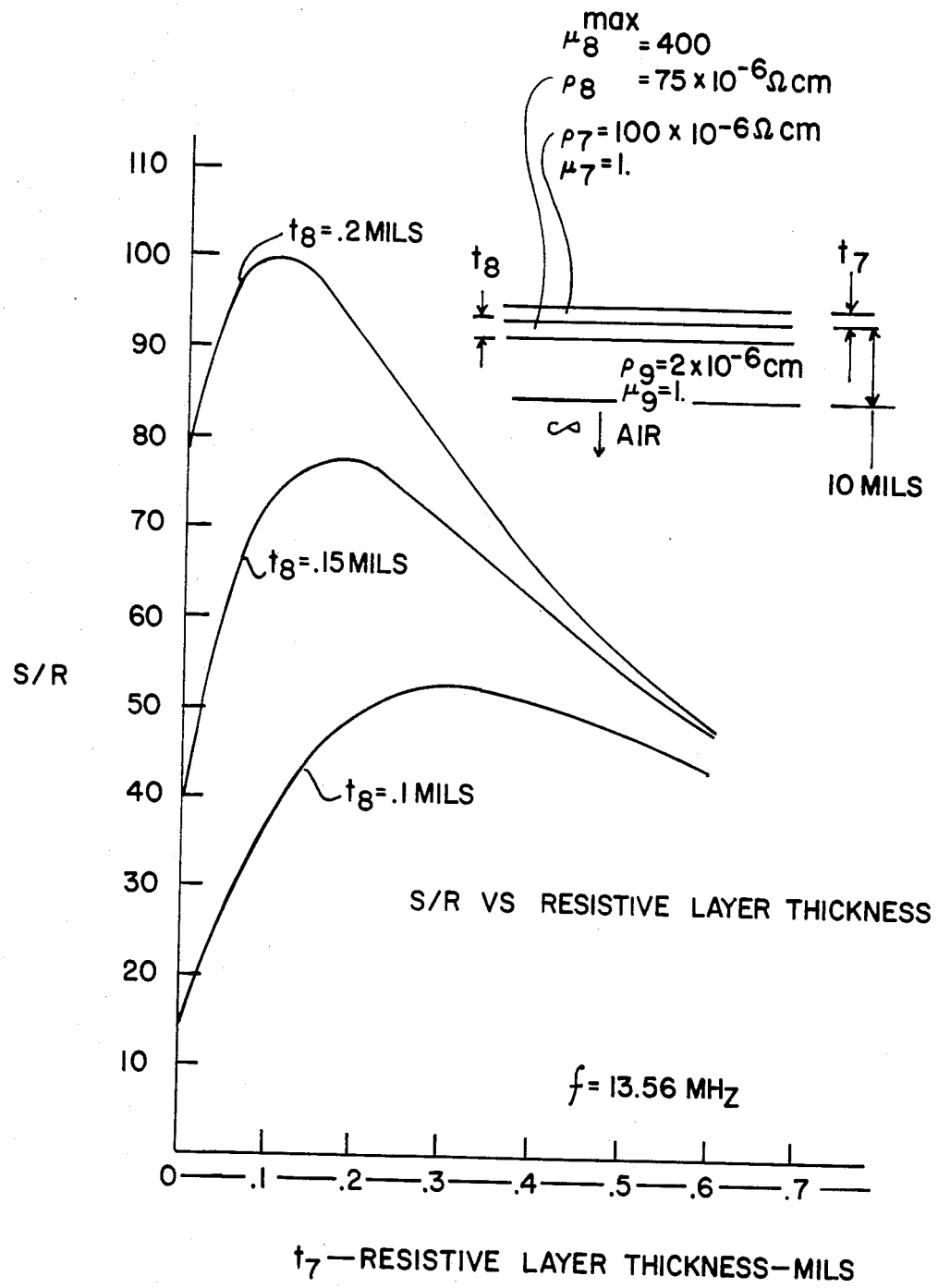
FIG. 8 is a graph illustrating the relation between resistive layer thickness, magnetic layer thickness and S/R.

MODE B. In this mode the magnetic layer is made less than one skin depth thick. The addition of a resistive surface layer 7 causes the S/R to increase initially with resistive layer 7 thickness $t_7$, reaching a maximum value beyond which increasing the resistive layer 7 thickness $t_7$ causes the S/R to decline in a manner similar to that of Mode A. FIG. 8 illustrates this behavior for three different magnetic layer 8 thicknesses $t_8$. Very high values of S/R are attainable with magnetic layer thicknesses less than one skin depth (δ). This behavior demonstrates that the switching action discussed above for Mode A operation also applies to Mode B.

Mode B operation should be especially applicable at lower frequencies where a thin magnetic layer 8 in terms of δ is desirable.

Figure 9:
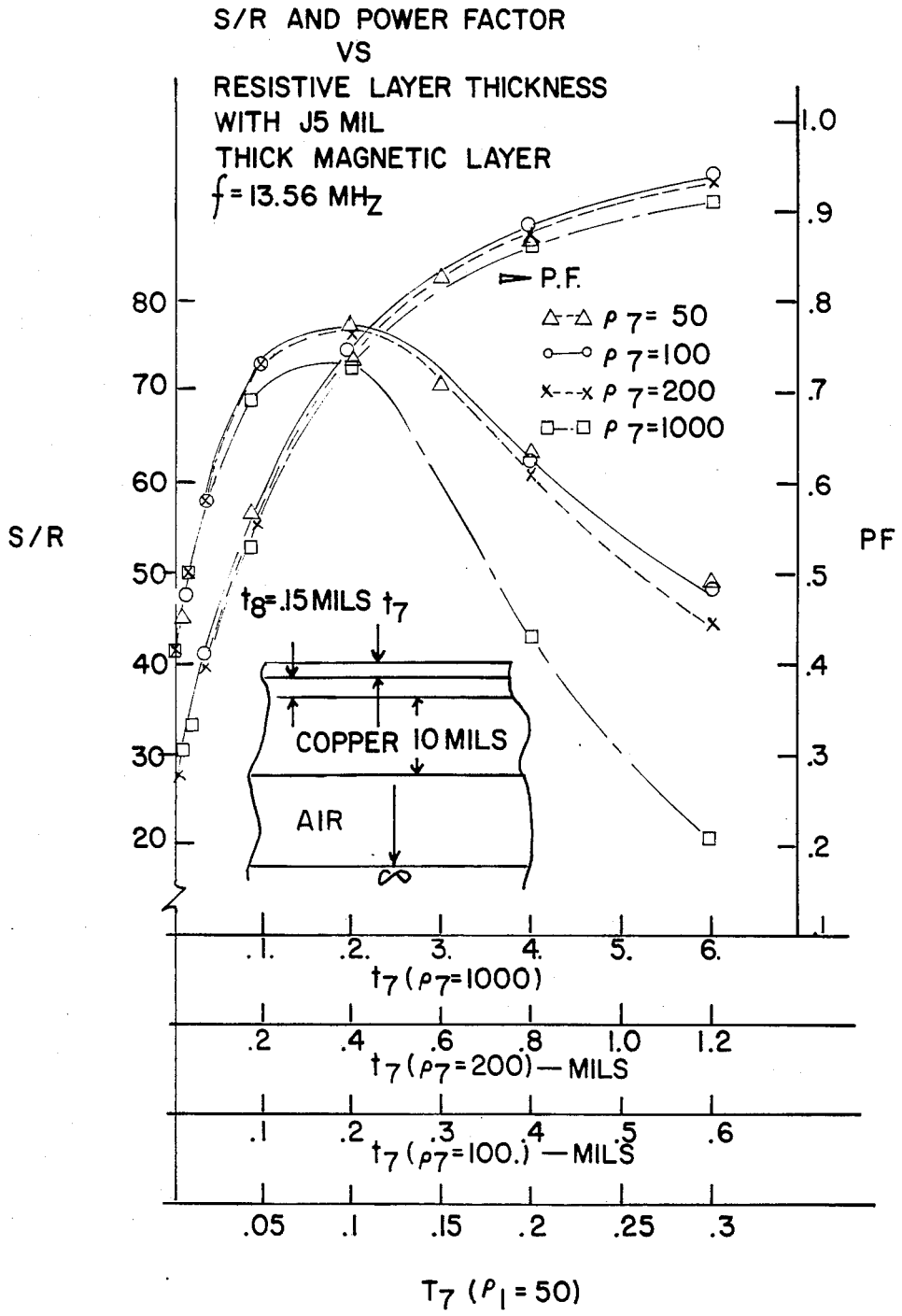
FIG. 9 is a graph illustrating the effect of the ratio of resistivity to layer thickness on S/R.

FIG. 9 depicts S/R ratio and power factor vs. resistive layer thickness for a 0.15 mil thick magnetic layer demonstrating that high S/R ratios can be achieved using a wide range of resistivities in the resistive layer 7. It also shows that, for the lower values of resistivity, equivalent performance is realized by maintaining to resistivity constant. In this last respect it is similar to Mode A operation.

Mode B operation is not as good as Mode A from the standpoint of power factor. To attain a 0.9 power factor, Mode A would yield as S/R of approximately 100 while Mode B would have a S/R of about 55.

Figure 10:
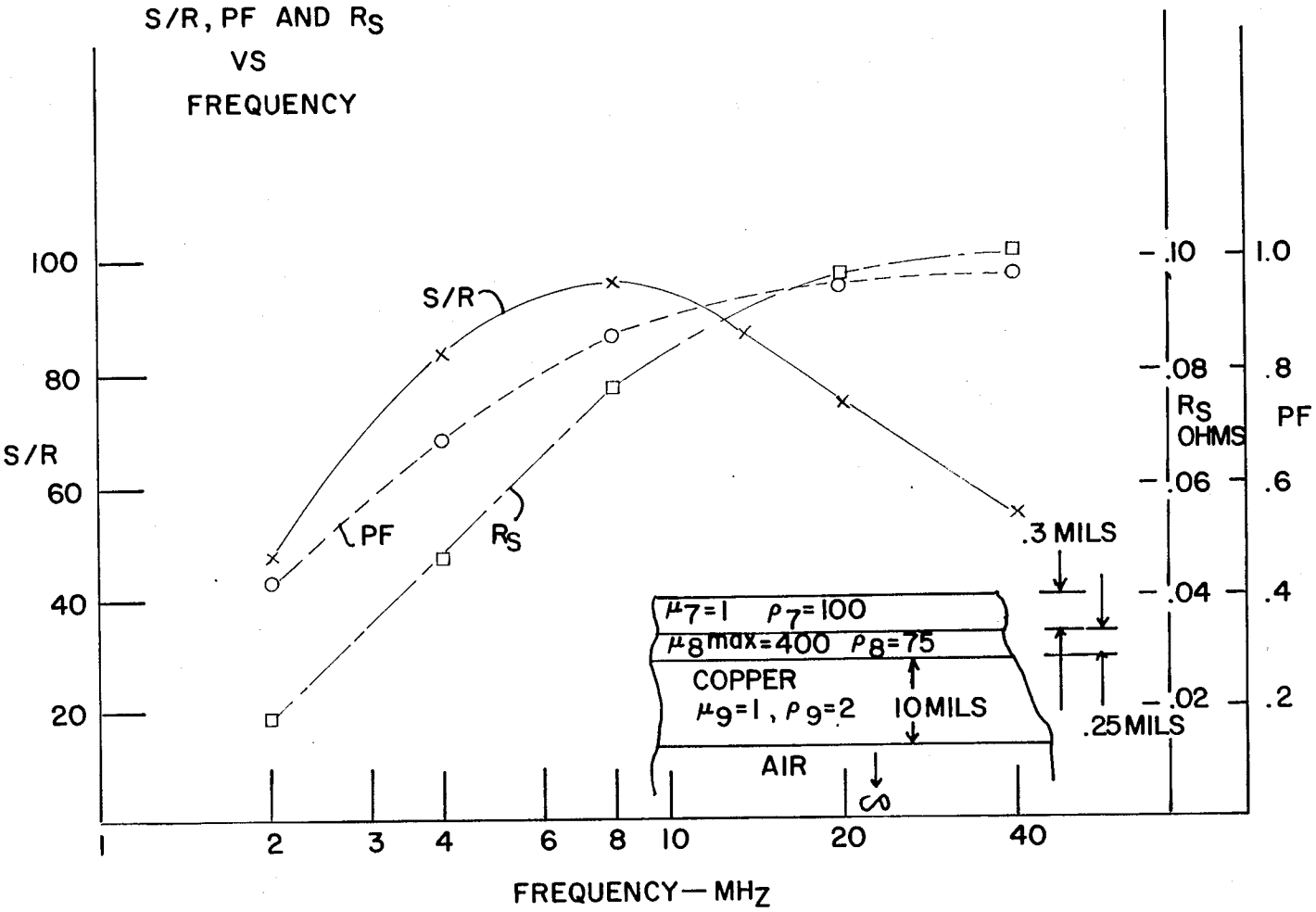
FIG. 10 is a graph illustrating the effect of supply current frequency on PF, S/R and surface layer resistance ($R_s$).

FIG. 10 illustrates the behavior of a "Mode A" design as a function of frequency. FIG. 10 illustrates that a frequency in the general range of 10–40 MHz would be desirable for this design. In this range the power factor is higher than 0.9, the surface resistance $R_s$ is adequately high and the S/R greater than 50.

The S/R decreases with decreasing frequency at the low end of the band because the magnetic layer is becoming too thin in terms of δ 's to effectively switch the current.

Figure 11A:
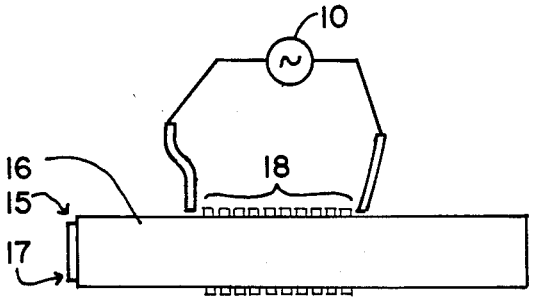
FIGS. 11 A and B are side and end views of a further embodiment of the improved heater of the present invention.

FIG. 11A illustrates a test fixture of an inductively energized embodiment of the present invention. A 0.0005" thick layer of electroless nickel 15 was deposited on a 0.345" diameter cylinder of annealled TC30-4 alloy 17 along a length of 3.75". This plating forms a two-layer cylindrical heater 16.

Figure 11B:
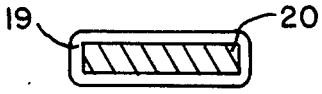

A twenty-seven turn helical coil 18 was wound on this layered cylinder 16 to provide a means for inductively energizing the heater with high frequency alternating current. The coil is comprised of Kapton-insulated 19 rectangular wire 20, 0.0035" by 0.040", the cross-section of which is shown in FIG. 11B. The turns were wound as tightly as practical on the cylinder 16 and as close together as practical in order to minimize magnetic field leakage reactance and thus achieve the optimum power factor.

Figure 12:
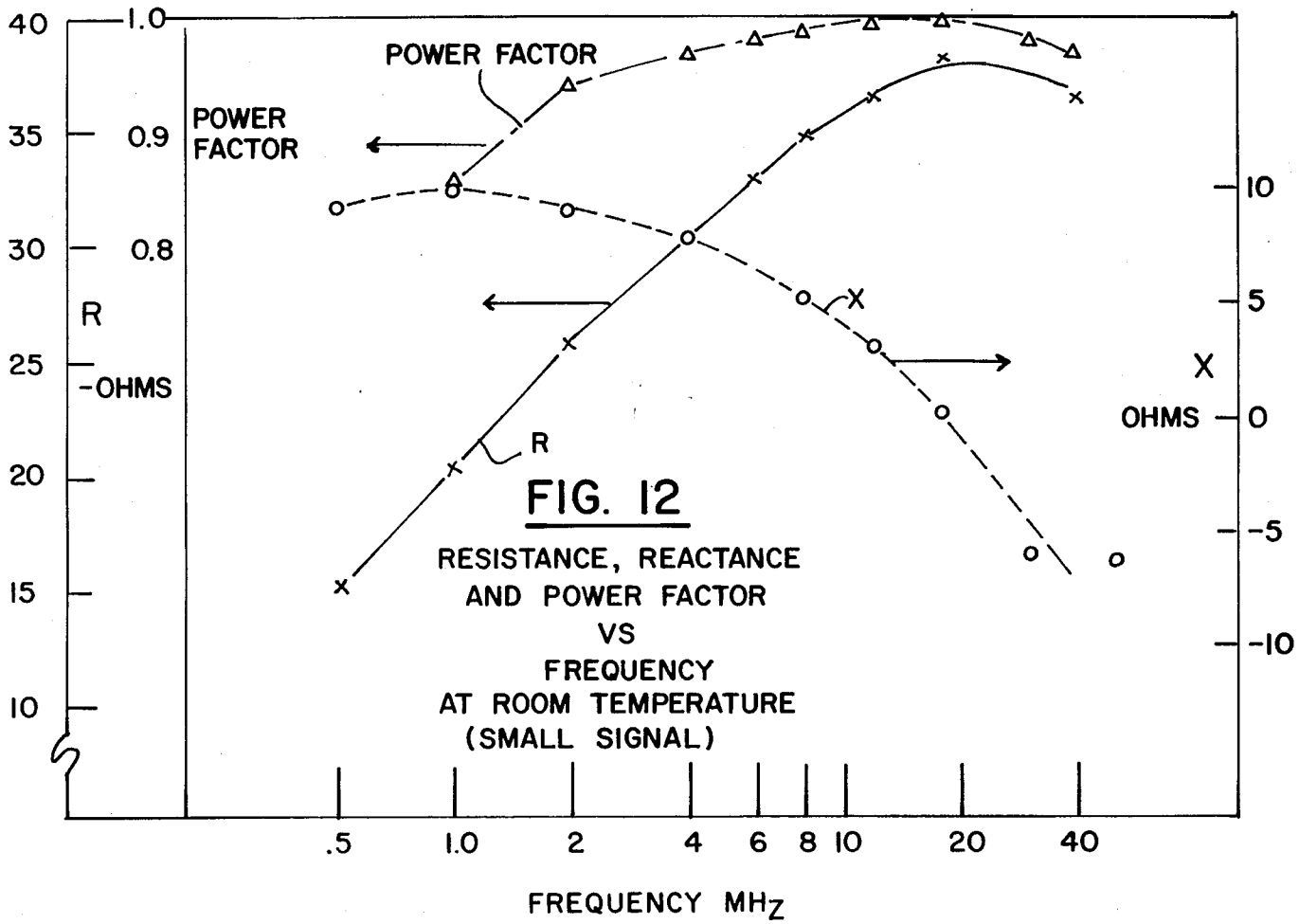
FIG. 12 is a graph illustrating the below Curie impedance of the present invention.

Measured small signal room temperature impedance properties of this test circuit are illustrated in FIG. 12, confirming expected below Curie high power factor properties. The slight reduction in PF at frequencies above about 20 MHz is due to the capacitance between coil turns. Of note is the slow variation of the impedance as a function of frequency, a property useful in heater design. From 2 MHz to 10MHz the resistance varies by only 40 percent.

Figure 13:
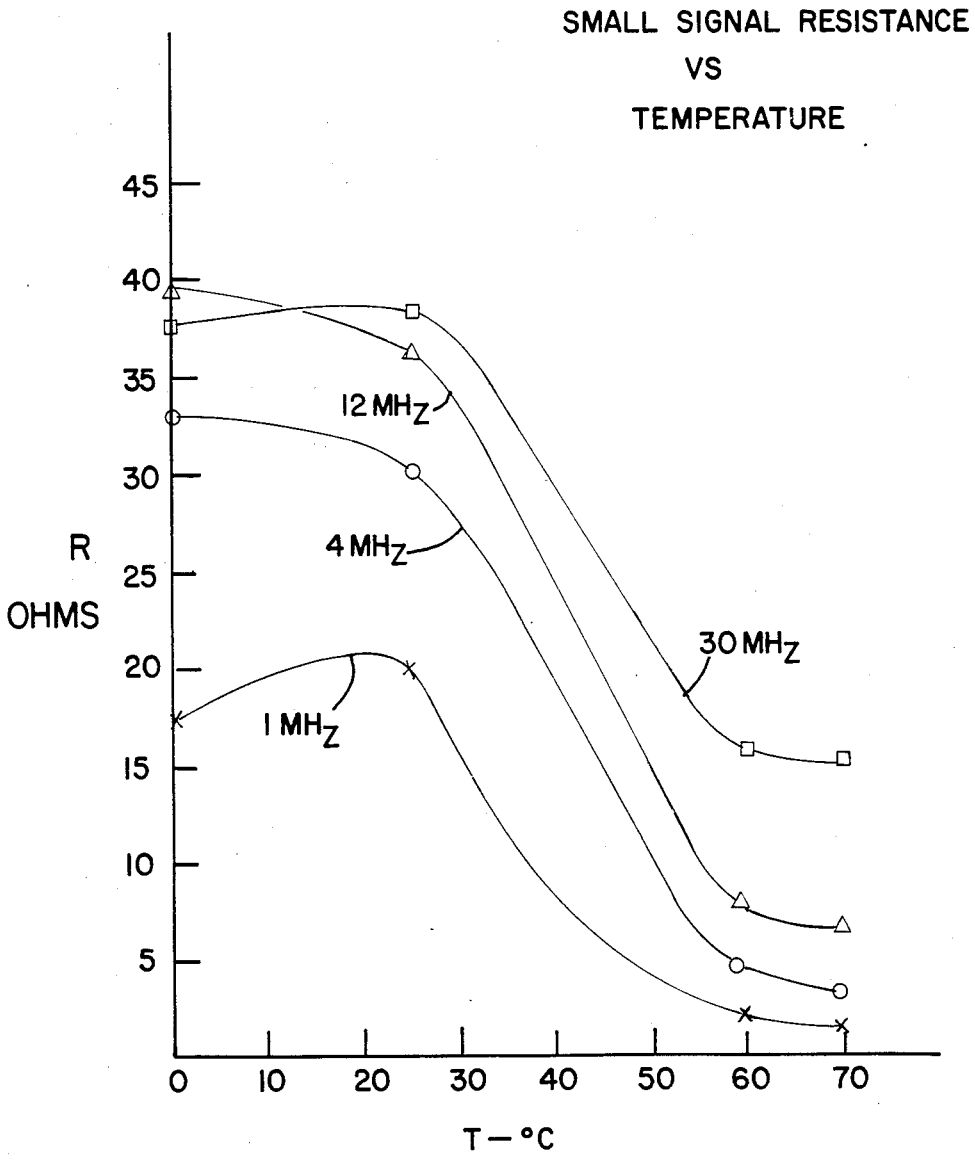
FIG. 13 is a graph illustrating resistance as a function of temperature of the heater at different frequencies.

FIG. 13 depicts the measured resistance as a function of temperature at several different frequencies and between 0° C. and 70°C. These measurements were made through a short length of cable, with the test heater mounted inside the environmental test chamber and the vector impedance meter outside it. The measured impedances were corrected for the effect of the cable.

Figure 14:
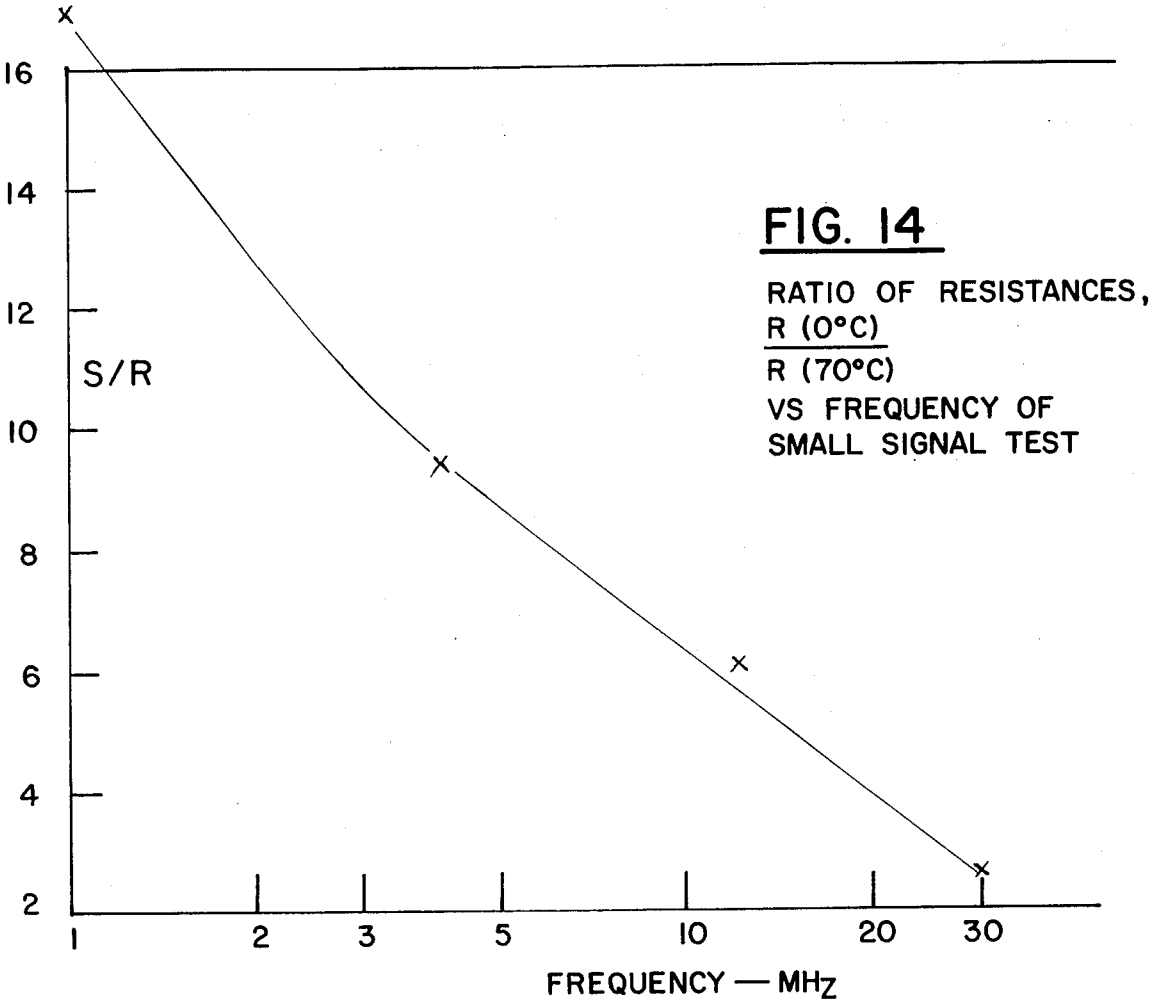
FIG. 14 is a graph illustrating the relation of resistance as a function of frequency.

FIG. 14 illustrates the ratio of the 0° C. and 70° C. resistances as a function of frequency. Referring to FIG. 12, a tradeoff between high power factor and high resistance ratio exists.

The maximum resistance ratio is equal to the square root of the permeability and occurs with a zero thickness resistive layer. The small signal permeability of TC30-4 is about 400 (from previous measurements). The maximum resistance ratio is therefore about 20, and as expected is higher than when a resistive layer is added.

Figure 15:
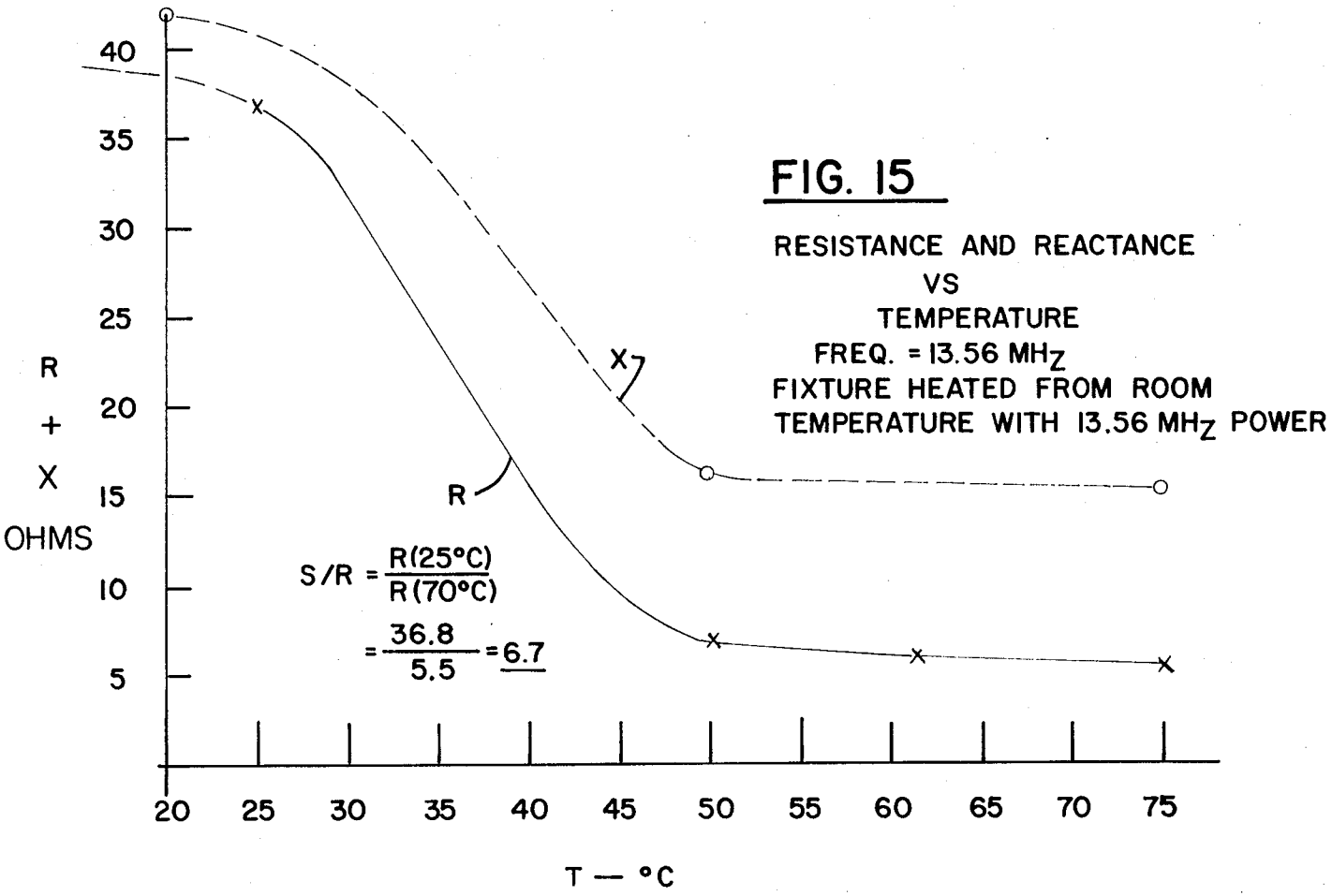
FIG. 15 is a graph illustrating resistance and reactance as a function of temperature at a fixed current frequency of 13.65 MHz.

The data of FIG. 15 demonstrate that the resistive layer carries most of the RF current, and that consequently the effective permeability of the magnetic material is higher under high power conditions than in the case where no resistive layer is used. The measured resistance ratio value of 6.7 is higher than the ratio (see FIG. 14) measured under small signal conditions. This ratio corresponds to a permeabiity of about 400 in the magnetic substrate.

FIGS. 10 and 12 show that a given heater structure, i.e., with fixed dimensions and electrical properties, could be operated over a moderately wide band of frequencies while maintaining useful performance properties. These curves do not, however, teach how to achieve the same electrical performance at a much different frequency. In order to do this the laws of electrical similitude must be brought to bear on the situation. These similitude or scaling rules are given by Stratton. ("Electromagnetic Theory" Section 9.3, pp 488–490, McGraw Book Co., New York, 1941) incorporated herein be reference.

Figure 16:
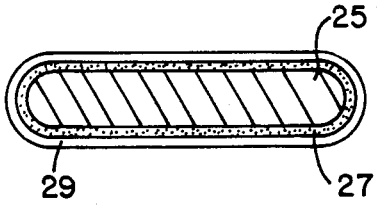
FIG. 16 is a cross-sectional end view of an alternative configuration of the embodiment of FIGS. 3 and 4.

FIG. 16 illustrates an embodiment wherein the magnetic layer is wholly enclosed within the high resistance layer and both layers are continuous; that is, closed layers. specifically a copper body 25 is enclosed within a magnetic layer 27 in turn enclosed within a high resistance layer 29 of non-magnetic material. The performance of such a structure is quite similar to the strucvture of FIG. 4 but does not suffer from demagnetizing effects since the magnetic layer is continuous.

Figure 17:
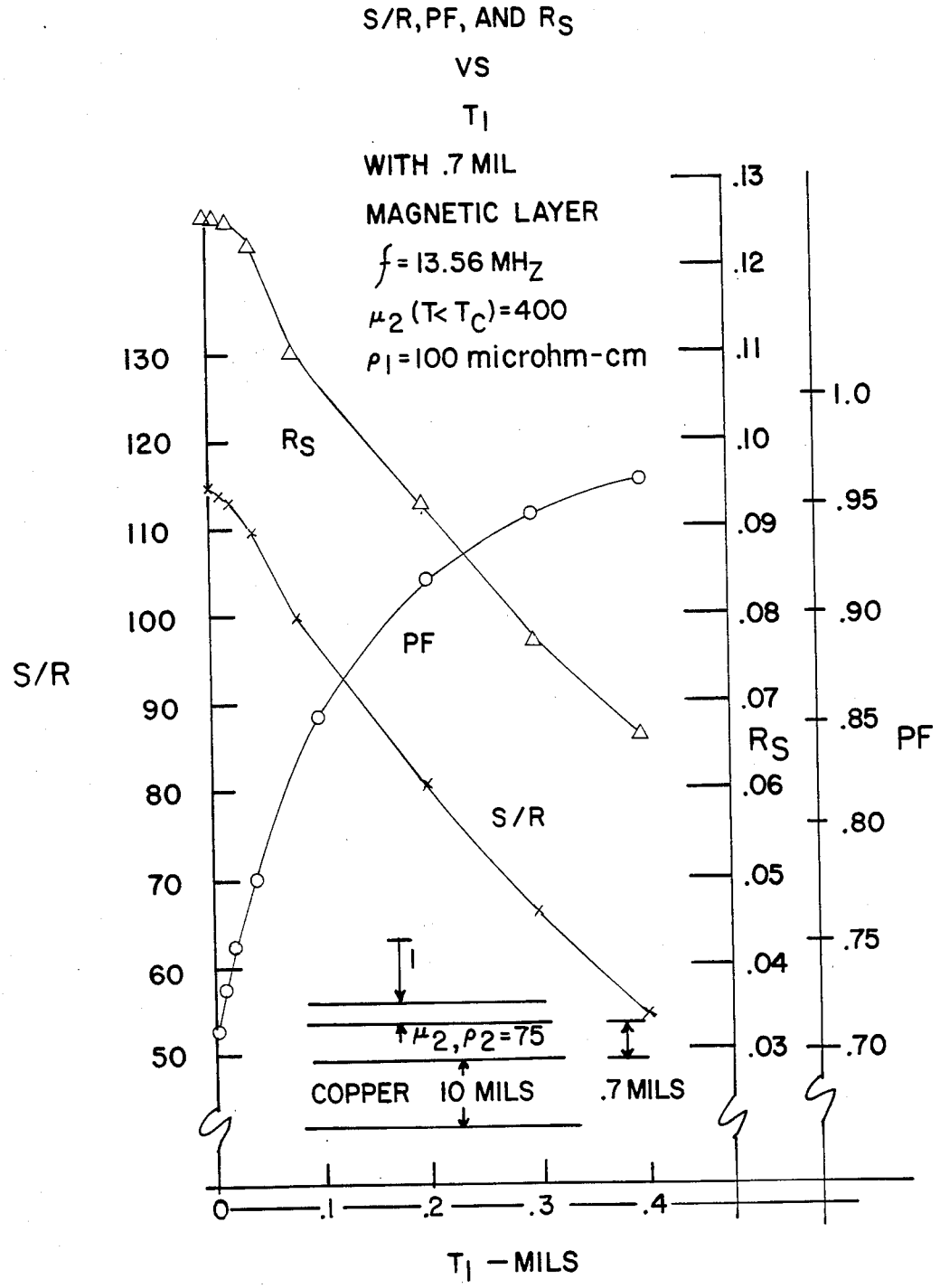
FIG. 17 is a graph illustrating S/R, $R_s$, And PF as a function of surface layer thickness for a given resistivity of the surface layer.

The effect of the thickness of the magnetic layer on performance of this device is illustrated in Figure 17. With a thickness of 0.7 mils, about 3 skin depths, the S/R ratio falls rapidly as a function of increasing thickness of the outer layer $T_1$; falling from S/R=115 to 54 with an increase of $T_1$ from 0 to 0.4 mils. Power factor rises rapidly as increasing percentages of current are confined to the resistive layer; rising from 0.55 to 0.96 over the plotted range.

Because many varying and different embodiments may be made within the scope of the inventive concept herein taught, and because many modifications may be made in the embodiment(s) herein detailed in accordance with the descriptive requirements of the law, it is to be understood that the details herein are to be interpreted as illustrative and not in a limiting sense.

What is claimed is:

1. An electrically resistive heating element comprising means for regulating the temperatures of said element within a given range by intrinsic variation of the resistance of said element within said temperature range, said means including a first layer of ferromagnetic material;

a second layer of high resistance non-magnetic material in thermal contact with said ferromagnetic layer, means for decreasing the effective reactance of said element at the lower end of said temperature range, said means for decreasing including said second layer and said first layer positioned relative to one another such that when a high frequency alternating current is developed in said layers, the current has a substantial portion confined to said second layer, and

2. The heating element of claim 1 further comprising, a layer of low resistance material in intimate thermal and electrical contact with said first layer on the opposite side of said first layer form the side contacted by said second layer.

3. The heating element of claim 2, wherein, the ferromagnetic layer is of a thickness to effectively switch the flow of current from said high to said low resistance layer as the element reaches its effective Curie temperature.

4. An electrically resistive heating element, comprising:

a non-magnetic substrate of high thermal and electrical conductivity, a ferromagnetic layer having a first planar face in intimate thermal and electrical contact with said substrate, a further non-magnetic layer of high electrical resistivity in intimate thermal and electrical contact with an opposite planar face of said ferromagnetic layer, and said ferromagnetic layer being sufficiently thin that upon the application of a constant current of sufficient magnitude to cause the ferromagnetic layer to approach its Curie temperature the majority of the current switches from said nonmagnetic layer of high electrical resistivity into said nonmagnetic substrate.

5. The heating element of claim 4, wherein, the thickness of said ferromagnetic layer is between $\frac{1}{3}$ and $\frac{2}{3}$ of a skin depth at a given operating frequency.

6. The heating element of claim 4, wherein, said further layer has resistivities in the range from 60 microhm-cm to 5,000 microhm-cm.

7. The heating element of claim 4, wherein, said further layer is comprised of electroless nickel.

8. The heating element of claim 4, wherein, said further layer is comprised of one of the variety of high resistivity alloys known as nichrome.

9. The heating element of claim 4, wherein, said further layer is comprised of an organic conductive polymer.

10. An electric heater comprising a high resistance element, a low resistance element, a ferromagnetic element, said ferromagnetic element located between and in thermal and electrical contact with said high resistance and said low resistance elements, and means for switching a current between said high resistance and low resistance elements, said means including means for connecting said elements in parallel to a source of high frequency constant current of sufficient magnitude to heat said ferromagnetic element to a temperature approaching its Curie temperature.

11. An electric heater comprising a high resistance element, a low resistance element, a ferromagnetic element, said ferromagnetic element located between and in thermal and electrical contact with said high resistance and said low resistance elements, and means for switching a current between said high resistance and low resistance elements, said means including means for developing in said elements a high frequency current generated by a constant current source of sufficient magnitude to heat said ferromagnetic element to a temperature approaching its Curie temperature whereby to reduce materially the permeability of said ferromagnetic element.

12. The method of maintaining a relatively high power factor in a self-regulating heater comprising the steps of initially confining a large proportion of current in a high electrical resistance layer during the period a layer of magnetic material which is in electrical and thermal contact with the high resistance layer is below its effective Curie temperature and allowing an increasingly large proportion of the current to spread into a lower resistance material as the temperature of the magnetic layer approaches its Curie temperature.

13. The method of maintaining a high power factor in a self-regulating multilayered heating element having low and high resistance non-magnetic layers and a magnetic layer lying between and in electrical contact with said layers, the method comprising confining the majority of the current to the high resistance layer below the effective Curie temperature of the magnetic material and switching the majority of the current to the low resistance layer as the effective Curie temperature of the magnetic layer is approached.

* * * * *

UNITED STATES PATENT AND TRADEMARK OFFICE

CERTIFICATE OF CORRECTION

PATENT NO. : 4,814,587

DATED : March 21, 1989

INVENTOR(S) : Philip S. Carter

It is certified that error appears in the above-identified patent and that said Letters Patent is hereby corrected as shown below:

Claim 1, add the following after the word "and" in the last line of the claim:

--means including a source of high frequency constant current for developing in said layers a high frequency alternating current sufficient to raise the temperature of said ferromagnetic layer to a temperature approaching its Curie temperature whereby the permeability of said ferromagnetic layer approaches 1.--

Signed and Sealed this

Eighteenth Day of December, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,814,587

DATED : March 21, 1989

INVENTOR(S) : Philip S. Carter

It is certified that error appears in the above-identified patent and that said Letters Patent is hereby corrected as shown below:

Column 5, line 6, "s2/μσω, for T>>s" should be --s= $\sqrt{2/\mu\sigma\omega}$, for T>>s--;

line 16, "$\mu_v$=4x10$^{-7}$" should be --$\mu_r$=4πx10$^{-7}$--;

"$\mu_r\mu/\mu_v$=μ/4" should be --$\mu_r$=μ/$\mu_v$=μ4--.

Signed and Sealed this

Twenty-eighth Day of April, 1992

*Attest:*

HARRY F. MANBECK, JR.

*Attesting Officer*

*Commissioner of Patents and Trademarks*